US006389145B2

(12) United States Patent
Baumhauer, Jr. et al.

(10) Patent No.: US 6,389,145 B2
(45) **Date of Patent: *May 14, 2002**

(54) METHODS AND APPARATUS FOR CONTROLLING THE OUTPUT OF MOVING ARMATURE TRANSDUCERS

(75) Inventors: John Charles Baumhauer, Jr., Indianapolis; Larry Allen Marcus, Fishers, both of IN (US)

(73) Assignee: Agere Systems Guardian Corp., Orlando, FL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/122,582

(22) Filed: Jul. 24, 1998

(51) Int. Cl.[7] ..... H04R 25/00

(52) U.S. Cl. ..... 381/345; 381/349; 381/417; 379/432

(58) Field of Search ..... 381/337, 338, 381/345, 348, 349, 350, 351, 371, 372, 417, 340; 181/155, 156, 145; 379/431, 432, 433, 430

(56) References Cited

U.S. PATENT DOCUMENTS

| | | | | | |
|---|---|---|---|---|---|
| 3,324,253 | A | * | 6/1967 | Uemura et al. | 381/417 |
| 3,542,974 | A | * | 11/1970 | Blastic et al. | 381/417 |
| 4,147,899 | A | * | 4/1979 | Mori et al. | 381/417 |
| 4,239,945 | A | * | 12/1980 | Atoji | 381/371 |
| 4,360,711 | A | * | 11/1982 | Steiner | 381/417 |
| 4,549,631 | A | * | 10/1985 | Bose | 181/155 |
| 5,432,860 | A | * | 7/1995 | Kasajima et al. | 381/340 |
| 5,974,157 | A | * | 10/1999 | Tajima et al. | 381/417 |

* cited by examiner

*Primary Examiner*—Huyen Le
(74) *Attorney, Agent, or Firm*—Priest & Goldstein, PLLC

(57) ABSTRACT

A moving-armature transducer assembly suitable for use as an alerter in a portable telephone. The assembly includes a transducer housed in an enclosure including first and second acoustical chambers. A first sound emitted from a front hole on a front side of the transducer is propagated through the first acoustical chamber and emitted from a first port of the assembly. A second sound emitted from a rear hole on a rear side of the transducer is phase-shifted by the second acoustical chamber acting in combination with a second port or ports on the assembly to have a phase coinciding with the phase of the first sound. The second sound then combines with the first sound, reinforcing the first sound and producing a combined sound having an increased level and bandwidth.

18 Claims, 4 Drawing Sheets

METHODS AND APPARATUS FOR CONTROLLING THE OUTPUT OF MOVING ARMATURE TRANSDUCERS

FIELD OF THE INVENTION

The present invention relates generally to improvements in portable telephones and the like. More specifically, the present invention relates to improvements in the acoustic output of narrowband magnetic transducers used in alerters, for such phones and devices, flowing from the use of a phase inverting acoustical enclosure.

BACKGROUND OF THE INVENTION

Magnetic transducers, devices which convert electrical energy into mechanical energy in the form of sound waves, are typically based on a moving-coil or a moving-armature design. Due to their small size and low cost, moving-armature magnetic transducers often find use in portable cordless or cellular phones as alerters which may also be referred to as ringers or buzzers. Typically, a moving-armature transducer includes a diaphragm which produces sound, the sound being emitted from front and rear holes in the transducer. Unlike moving-coil (dynamic) magnetic transducers found in high fidelity speakers and telephone earpiece receivers, smaller moving-armature magnetic transducers having much stiffer diaphragms are narrowband frequency response devices which typically only operate in the 1800 Hz to 2800 Hz range, rendering them unsuitable for use in speech reproduction. In contrast, a moving-coil magnetic transducer can functions from approximately 300 Hz through 3300 Hz and higher, the frequency range typically used to reproduce the human voice for telephone communications.

Most designers of telephone sets use narrowband magnetic transducers as alerters by merely placing an acoustical output hole in the transducer close to a port in a housing of a telephone handset. This design is haphazard because acoustical leaks can greatly affect the output volume, not only lowering the output volume, but causing great variability in the output volume among individual telephone sets. Sound from the front output hole can leak into the telephone housing so that less sound gets through the telephone housing port and to the listener. Sound output from the back of the diaphragm also escapes from a rear hole in the transducer and, through destructive interference, can cancel sound from the front hole, either within the telephone housing or in the listening space.

A more sophisticated mounting scheme uses a gasket, which is typically soft rubber or closed cell foam, to seal around the front of the narrowband magnetic transducer and prevent the sound from the front hole from leaking into the housing or being canceled by sound from the rear hole. But even in this scheme, the sound from the rear holes is lost in the telephone set or leaks out of openings in the set and partially cancels sound from the front hole within the listening space.

U.S. Pat. No. 5,655,017 discloses a portable telephone with a detachable speaker suitable for voice communication having a moving-coil magnetic transducer based on a bass reflex design. The bass reflex speaker increases the acoustic response of the wideband moving-coil magnetic transducer in the frequency range for voice reproduction in hi-fidelity products and telephone communications. For example, a typical moving-coil loudspeaker, 25 mm in diameter and thus approximately 500 square mm in area, might typically have a resonance frequency around 700 Hz. A successful bass reflex design to extend the response to even lower frequencies would require a rear acoustical enclosure in excess of 50 cubic centimeters (cc). In contrast, a miniature moving-armature transducer, such as might be utilized by ever smaller portable telephone and communicator alerters needs to take up less than half that area and be coupled to a far smaller rear enclosure having a volume of approximately 1 to 10 cc. In combination, the resulting lower mass and lower compliance of the moving-armature transducer's diaphragm and the enclosure's acoustical compliance produce resonance frequencies in the neighborhood of 2000 Hz. Thus, these magnetic transducers are typically used in very different applications from those in which moving-coil transducers are used. Existing moving-armature alerter designs suffer from having a low acoustical output level due to their small size, as well as narrowband response at higher frequencies. Because of their inherent low compliance and narrowband response, it was not immediately apparent that a moving-armature mechano-acoustic system could be made to function satisfactorily in a phase-inverting mode, particularly with a miniaturized rear acoustical enclosure of the size allowable given typical design constraints in space restricted applications such as portable phones.

SUMMARY OF THE INVENTION

The present invention provides improved acoustical alerting output of a narrowband moving-armature transducer which may be advantageously contained within a telephone housing. As addressed above, presently, sound from the front hole of the transducer is typically directed outside of the housing, providing an audible alerting signal, while sound from the rear holes of the transducer is typically directed into the housing and attenuated or lost. While moving-armature magnetic transducers are reasonably high in output sound pressure level over a narrow frequency band, they could be even more efficient if the sound directed into the housing could be redirected out of housing, in the correct phase, so as to reinforce the sound generated by the front of the diaphragm and associated front port. When used as the alerter in cordless telephones, the primary complaint against moving-armature magnetic transducers is their low acoustic level. Therefore, improvements in the audible acoustic output of these devices would be extremely advantageous.

The present invention provides methods and apparatus for increasing the audible output of narrowband magnetic transducers. As discussed above, the sound output from the rear hole of the narrowband magnetic transducer may be lost in the telephone set or leak out of the housing and partially cancel the sound emitted from the front hole of the transducer. A more efficient implementation of a narrowband magnetic transducer would minimize this interference and use the sound from the rear hole to reinforce the sound emitted from the front hole.

The present invention advantageously utilizes a phase inverting acoustical enclosure contained within the telephone handset to augment the sound output of the front hole of a narrowband magnetic transducer. With the phase inverting acoustical enclosure tuned to a frequency below the diaphragm's resonance frequency, the front hole output is generally reinforced in the frequency band from below the diaphragm resonance to up through the diaphragm resonance. Thus, the acoustical output increases within a frequency bandwidth that is more advantageous for customer alerting. In addition to the higher output sound pressure level, the widened frequency response is extremely useful to: (1) provide a more pleasant lower-frequency alerting signal, (2) provide an alerting signal not as readily attenuated within a room environment in which a portable telephone may be subject to use, (3) provide an alerting signal more likely to be heard by certain listeners with a particular frequency of hearing loss, and (4) provide an alerting signal comprised of multiple frequency components both to avoid being masked by room noise and to provide for distinctive alerting. Utilizing the present invention, these advantages can be enjoyed without the need to deliver additional power to the magnetic transducer, or use a larger or more expensive magnetic transducer.

In addition to cordless telephone handsets, the present invention's applicability extends to other devices, such as cellular or wireless mobile phones, or other devices that use a narrowband magnetic transducer in a small volume for providing an alerting signal.

A more complete understanding of the present invention, as well as further features and advantages, will be apparent from the following Detailed Description and the accompanying drawings.

DETAILED DESCRIPTION

The present invention provides methods and apparatus for increasing the output of narrowband acoustical alerters by utilizing a phase inverting acoustical enclosure contained within the telephone handset to augment the sound level output. The present invention now will be described more fully with reference to the accompanying drawings, in which several presently preferred embodiments of the invention are shown. This invention may, however, be embodied in various forms and should not be construed as limited to the embodiments set forth herein; rather, applicants provide these embodiments so that this disclosure will be thorough and complete, and will fully convey the scope of the invention to those skilled in the art.

Figure 1:
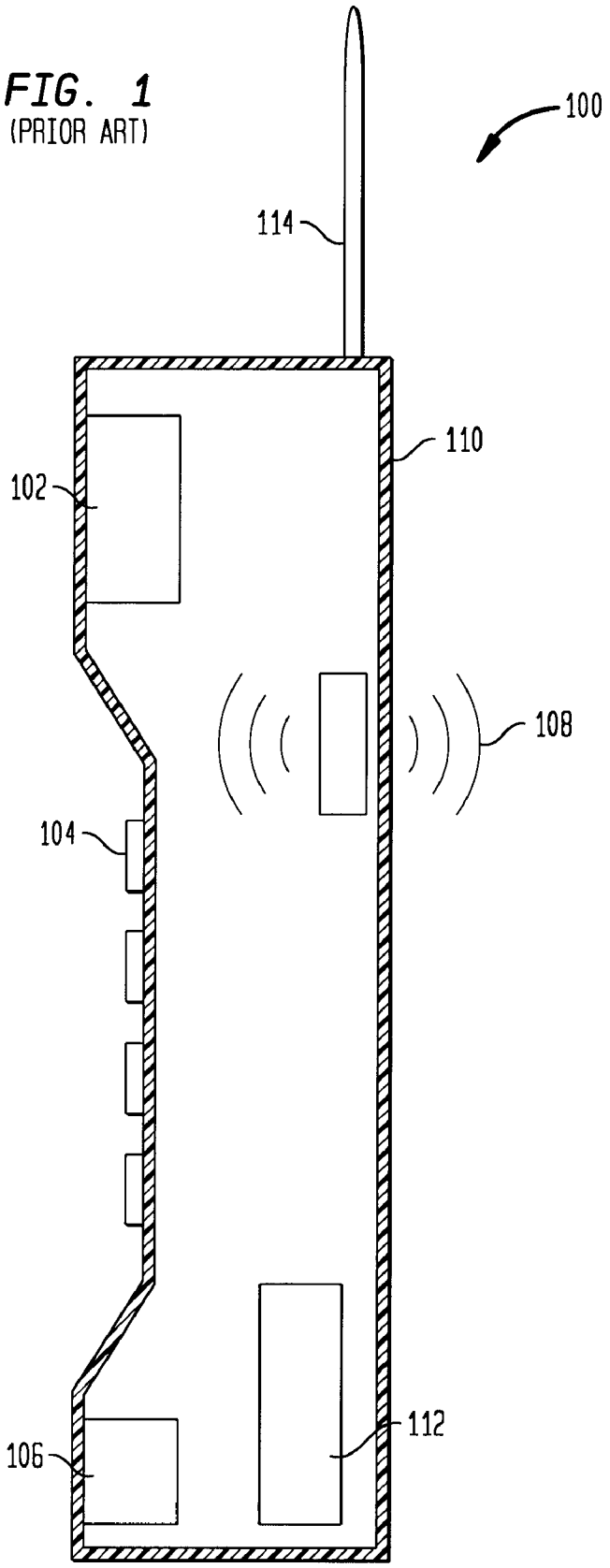
FIG. 1 (PRIOR ART)
FIG. 1 is a dross sectional drawing of a typical art cordless telephone handset.

FIG. 1 shows a cross sectional view of a typical prior art cordless telephone handset 100. An antenna 114 and a keypad 104 connect to the exterior of a housing 110. A microphone 106 is contained within the housing 110. A moving-coil magnetic transducer 102 is mounted inside the housing 110 and functions as the earpiece. Power for the handset 100 is provided by a battery 112. A narrowband moving-armature magnetic transducer 108 provides an audible alerting signal.

Figure 2:
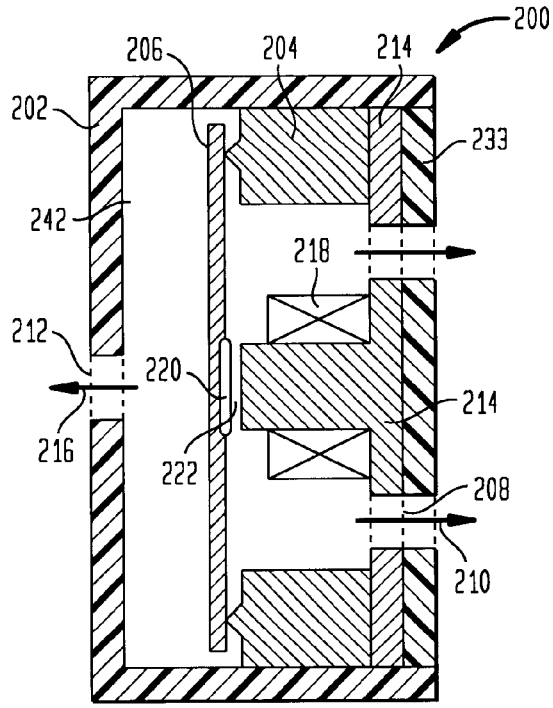
FIG. 2 is a cross sectional drawing of a cylindrical narrowband moving-armature magnetic transducer.

FIG. 2 is a cross sectional drawing of an exemplary cylindrical narrowband moving-armature magnetic transducer 200 of diameter 16 mm and depth 8.5 mm suitable for use in accordance with the teachings of the present invention. This transducer 200 may be utilized with the enclosure 300 of FIG. 3 to replace transducer 108 in handset 100 of FIG. 1 as discussed further below. A circular diaphragm 206 connects to a cylindrical permanent magnet 204. A circular armature 220 is bonded to the circular diaphragm 206. A pole 214 is positioned within the magnet 204, leaving a working air gap 222 between the center of the armature 220 and the pole 214. A coil 218 winds around the pole 214. A printed wiring board 233 connects to a case 202 and pole 214. The case 202 encloses the diaphragm 206, armature 220, magnet 204, pole 214, working air gap 222, coil 218 and printed wiring board 233, while connecting to the magnet 204. The case 202 includes a front hole 212. The pole 214 and printed wiring board 233 are formed to provide rear holes 208. A direct sound pressure 216 is emitted from the front hole 212, while a phase inverted sound pressure 210 (compared to direct sound pressure 216), from the rear side of the diaphragm 206, is emitted from the rear holes 208.

The attraction of permanent magnet 204 mechanically biases the magnetically conducting diaphragm 206 so that a static distance, called a working air gap 222, between the diaphragm 206 and the pole 214 is created. The magnetically conducting armature 220 serves to direct magnetic flux across the working air gap 222 in an efficient manner to allow transduction. When a signal current flows through the coil 218, the magnetic attraction between the diaphragm 206 and pole 214 within the working air gap 222 is varied and the diaphragm 206 moves, creating a sound pressure level that varies with the magnitude of current applied. While direct sound 216 is emitted from the front hole 212 of the case 202, phase inverted sound 210 is emitted from the rear holes 208. When the direct sound 216 collides with the phase inverted sound wave 210, destructive interference between the opposing phase of the two waves causes a reduction in the sound level heard by a listener.

Figure 3:
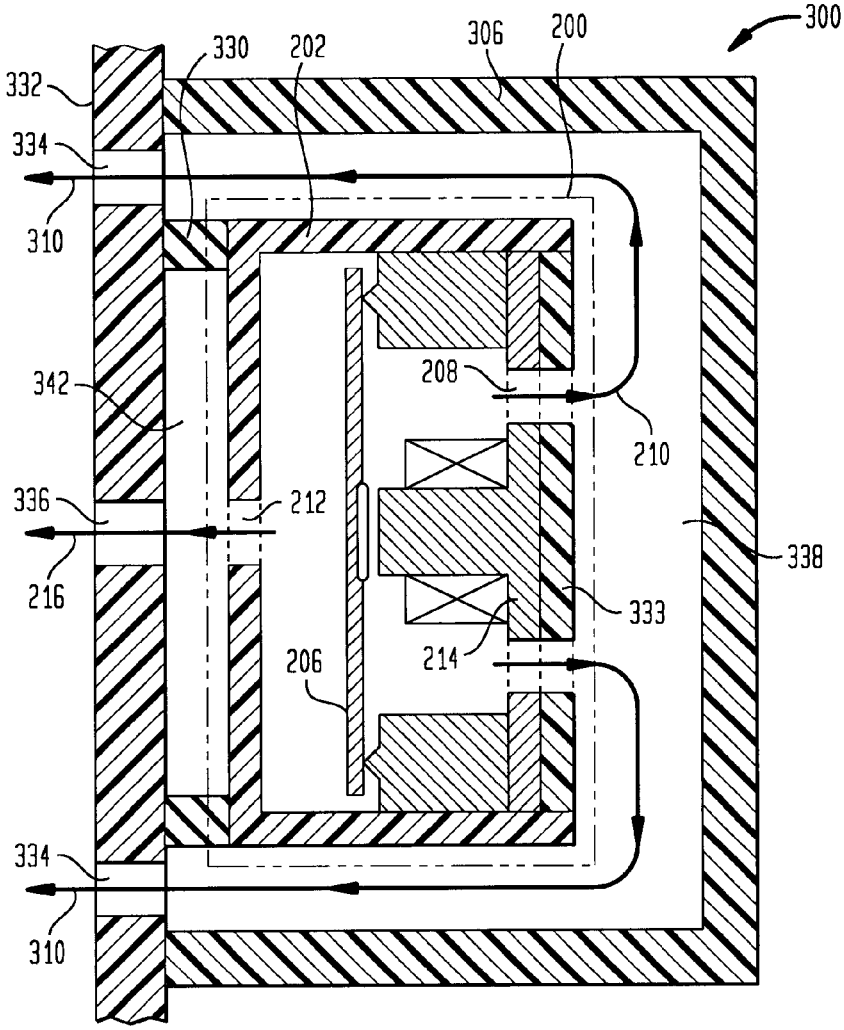
FIG. 3 is a cross sectional drawing of a first mounting scheme for a narrowband moving-armature magnetic transducer in accordance with the present invention.

FIG. 3 is a cross sectional drawing of an exemplary acoustical enclosure based mounting arrangement 300 for the narrowband moving-armature magnetic transducer 200, described above in FIG. 2, in accordance with the present invention. A presently preferred transducer for use as the transducer for use as the narrowband moving-armature magnetic transducer 200 is the KB-12G, a 16 ohm resistance device that may be obtained from SWC Electronics Ltd. Unless otherwise noted, the dimensions given herein are for a design hereinafter referred to as Design I. The magnetic transducer 200 connects to a cylindrical gasket 330 which is typically composed of a soft rubber, foam or glue. The magnetic transducer 200 contains the front hole 212 and rear holes 208. The cylindrical gasket 330 connects to a housing wall 332 of thickness 2.5 mm containing a front port 336, 3.0 mm in diameter, which is positioned alongside, but not immediately adjacent to, the front hole 212. A front acoustic cavity 342 of volume 0.08 cc is thus formed. A cylindrical acoustical enclosure 306 abuts the housing wall 332 and encloses the magnetic transducer 200 and the gasket 330, forming a phase inverting rear acoustical cavity 338 having a volume of 1.6 cc. The housing wall 332 also contains two rear ports 334, 2.0 mm in diameter, which are positioned outside the gasket 330, but inside the acoustical enclosure 306. The direct sound pressure 216 emitted from the front hole 212 propagates through the front port 336. The phase inverted sound pressure 210 emitted from the rear holes 208 passes through the phase inverting acoustical cavity 338 and rear ports 334 before being emitted from the rear ports 334 as a rear sound component 310. It should be appreciated that variations on this design may be readily employed to achieve a variety of design objectives. For example, the design may be varied depending upon the electrical drive signal to be employed or the resonant frequencies of operation desired. As alternative design, which may be referred to as Design II, varies from Design I in that the front port 336 is 0.9 mm in diameter and the rear ports 334 are 2.8 mm in diameter.

When a current passes through the coil 218 of magnetic transducer 200, the sound emitted from the front hole 212 is passed through the front port 336, with the gasket 330 preventing or substantially reducing sound leaks into the interior of the phone. The phase inverted sound 210 from the rear holes 208 passes through the phase inverting acoustical cavity 338 and rear ports 334, which are tuned for Design I to a frequency advantageously below the diaphragm 206 resonance frequency of the magnetic transducer 200. Likewise, for Design II, the resonance frequency associated with the phase inverting cavity 338 and rear ports 334 is advantageously below the diaphragm 206 resonance frequency of the magnetic transducer 200. Thus, for both Design I and Design II, the sound from the rear ports 334 reinforces the direct sound 216 emitted from the front port 336, resulting in an increased sound pressure level and wider frequency response. The rear sound 310 emitted from the rear ports 334 is now in phase with the direct sound 216. The resonance frequency of the rear ports 334 is inversely proportional to the square root of the product of the compliance of the acoustical cavity 338 and the acoustic mass of the rear ports 334. The acoustic mass may be adjusted higher by reducing the port diameter and/or increasing the port thickness. The acoustic mass may be adjusted lower by increasing the port diameter and/or reducing the port thickness. It is noted that the transducer case 202 conveniently provides a portion of the boundary of acoustical cavity 338.

Figure 4:
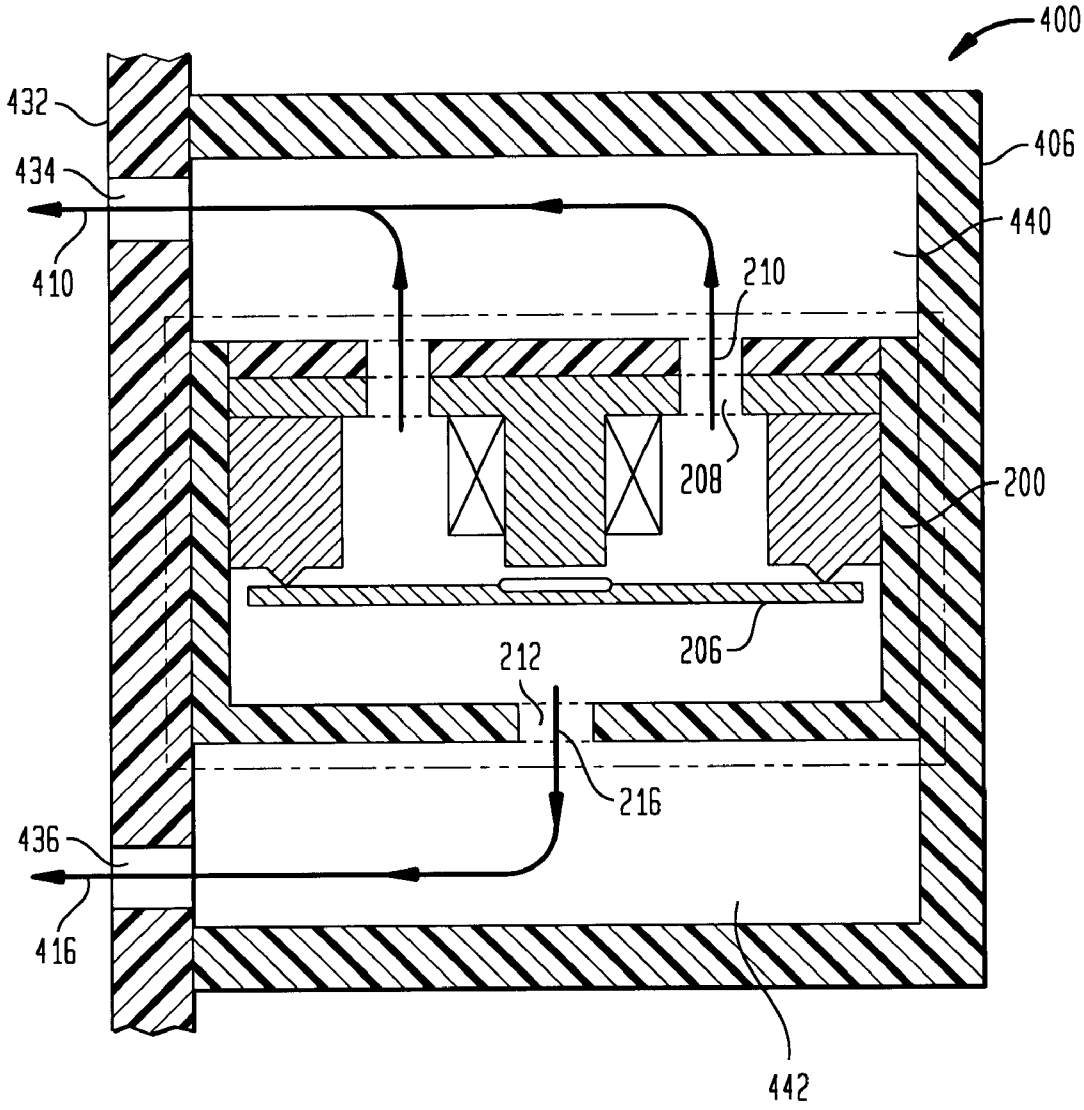
FIG. 4 is a cross sectional drawing of a second mounting scheme for a narrowband moving-armature magnetic transducer in accordance with the present invention.

FIG. 4 is a cross sectional drawing of a second exemplary acoustical enclosure based mounting arrangement 400 for the narrowband moving-armature magnetic transducer 200 of FIG. 2, in accordance with the present invention. Again, the narrowband moving-armature magnetic transducer 200 may suitably be the KB-12G, a 16 ohm resistance device, which may be obtained from SWC Electronics Ltd. The magnetic transducer 200 connects to a housing wall 432, such as a wall of the telephone handset 100 of FIG. 1. Unless otherwise noted, the dimensions given are those for a design referred to as Design III. The housing wall 432 of thickness 2.5 mm contains a front port 436, 3.0 mm in diameter, and rear ports 434, 2.0 mm in diameter. A cylindrical acoustical enclosure 406 connects to the magnetic transducer 200 and the housing wall 432 forming a front acoustical cavity 442 having a volume of 0.08 cc, and a rear phase inverting acoustical cavity 440 having a volume of 1.6 cc. The direct sound pressure 216 emitted from the front hole 212 propagates through the front acoustical cavity 440 before being emitted from the front port 436 as direct sound 416. The phase inverted sound pressure 210 emitted from the rear holes 208 propagates through the phase inverting acoustical cavity 440 and rear ports 434 before being emitted from the rear ports 434 as a rear sound 410. Design IV varies from Design III in that the front port 436 is 0.9 mm in diameter and the rear ports 434 are 2.8 mm in diameter.

When a current passes through the coil 218 of magnetic transducer 200, the direct sound 216 emitted from the front hole 212 passes through the front acoustical cavity 442 and front port 436, becoming direct sound 416. The phase inverted sound 210 from the rear holes 208 passes through the phase inverting acoustical cavity 440 and rear port 434, which is tuned for Design III to a frequency advantageously below the magnetic tranducer's diaphragm 206 resonance frequency of the magnetic transducer 200. Likewise, Design IV, the resonance frequency associated with the phase inverting cavity 440 and rear ports 434 is advantageously below the diaphragm 206 resonance frequency of the magnetic transducer 200. The rear sound 410 emitted from the rear port 434 is now in phase with the direct sound 416. Thus, for both Design III and Design IV, the sound from the rear port 434 reinforces the direct sound 416 emitted from the front port 436, resulting in an increased sound pressure level and wider frequency response. The resonance frequency of the rear port 434 is inversely proportional to the square root of the product of the compliance of the acoustical cavity 440 and the acoustic mass of the rear port 434. The acoustic mass may be adjusted higher by reducing the port diameter and/or increasing the port thickness. The acoustic mass may be adjusted lower by increasing the port diameter and/or reducing the port thickness.

This arrangement allows the energy associated with all resonances to combine constructively and to produce a high output and enhanced bandwidth. The enhanced alerting response can be at lower frequencies than prior designs have readily allowed. Thus, the present invention allows for alerting signals composed of multiple frequencies (distinctive ringing) that are more pleasant and not as easily masked by noise. This aspect is particularly useful for those listeners with high frequency hearing loss.

Figure 5:
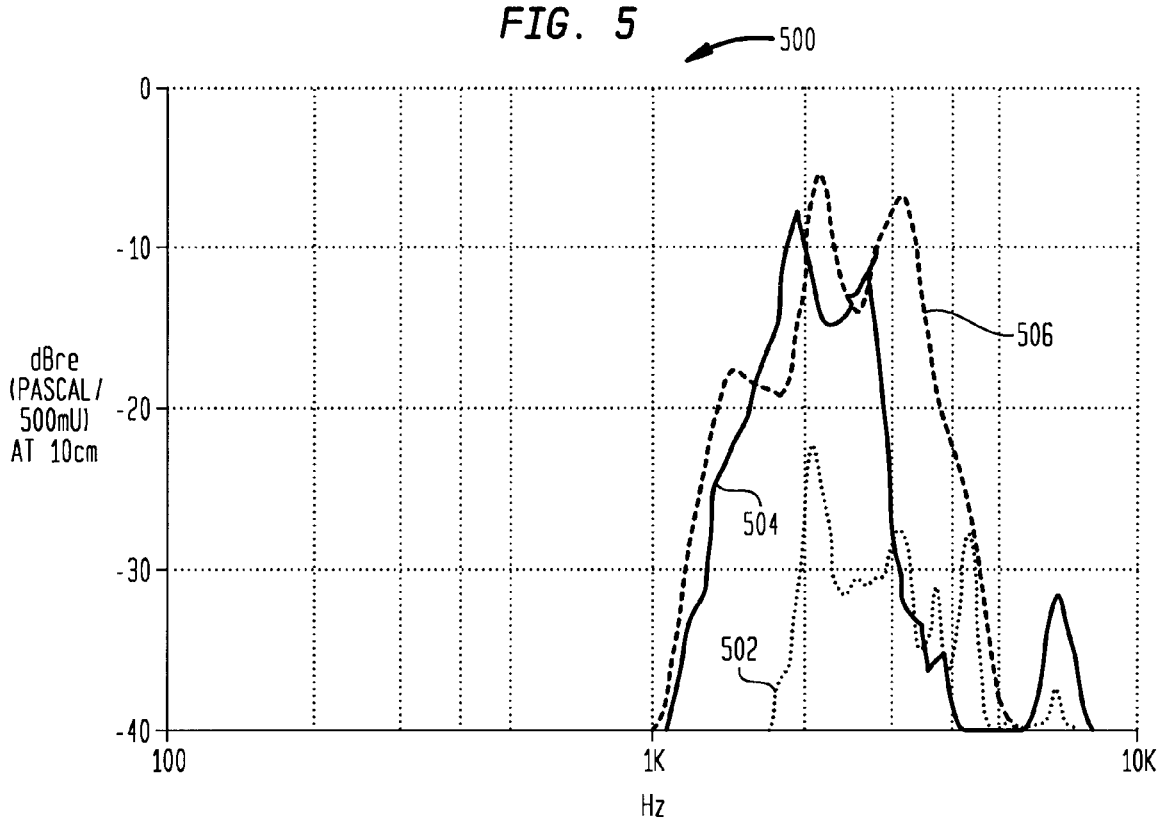
FIG. 5 is a graph showing the frequency response of a narrowband moving-armature magnetic transducer for various mounting schemes in accordance with the present invention.

FIG. 5 is a graph 500 showing a comparison of a first sound output curve 502 reflecting a sound output of a moving-armature transducer assembly of the prior art, a second sound output curve 504, reflecting a sound output of a moving-armature transducer assembly according to Design I of the present invention, described in connection with the discussion of FIG. 3. FIG. 5 also includes a third sound output curve 506, reflecting a sound output of a moving-armature transducer assembly according to Design II of the present invention, also described in connection with the discussion of FIG. 3. It can be readily seen that each of the second and third sound output curves 504 and 506 reflects a greater frequency range than the first sound output curve 502 and also reflects a substantially higher sound level than does the first sound output curve 502. Modifications of the design of a moving-armature assembly such as Design I or Design II can be made depending on a particular output curve desired. As indicated earlier, the diaphragm resonance frequency is higher than the frequency associated with the phase inverting cavity and ports. Namely, in output curves 504 and 506, the diaphragm resonance frequency is seen to be 2700 and 3100 Hz, respectively. Similar output curves will be produced by the moving-armature assemblies of Design III and Design IV, with the selection of appropriate dimensions for those designs.

Figure 6:
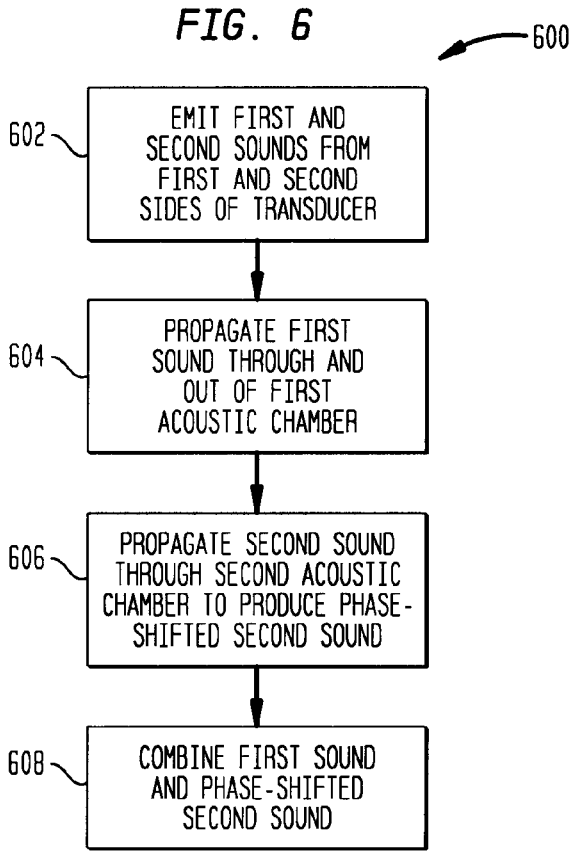
FIG. 6 is a flowchart of a process in accordance with a present invention.

FIG. 6 is a flowchart 600 illustrating a method of sound enhancement for a moving armature transducer according to the present invention. At step 602, a first sound is emitted from a first side of the transducer and a second sound is emitted from a second side of the transducer. At step 604, the first sound is directed into a first acoustical cavity and out of the first acoustical cavity. At step 606, the second sound is directed into a second acoustical cavity and phase-shifted to be in phase with the first sound, combining with the first sound so as to reinforce the first sound.

We claim:

1. A portable phone alerter having a sound output enhanced magnetic transducer assembly comprising:

a moving-armature magnetic transducer mounted within an enclosure in the portable phone and adapted to emit a first sound from a first portion and simultaneously to emit a second sound from a second portion, the first sound and the second sound both having a phase, the phase of the second sound differing from the phase of the first sound;

the enclosure for the magnetic transducer having a first and a second compartment, the first compartment being adapted to receive the first sound and to direct the first sound toward a first exit of the enclosure, the second compartment being adapted to receive the second sound and to redirect the second sound toward a second exit, the second compartment and exit together producing a phase-shifted second sound such that the phase-shifted second sound has a phase in accordance with the phase of the first sound so as to cause the phase-shifted second sound to constructively combine with the first sound so that the first and second sounds combine to produce a combined sound having a peak sound output greater than a peak sound output of the first sound or a peak sound output of the second sound, said combined sound for providing an audible alert.

2. The assembly of claim 1 wherein the first sound is emitted from a front hole of the transducer and the second sound is emitted from one or more rear hole of the transducer.

3. The assembly of claim 2 wherein the phase of the second sound emitted is opposite to the phase of the first sound emitted.

4. The assembly of claim 3 wherein the second compartment and second exit together reverse the phase of the second sound.

5. The assembly of claim 4 wherein the first compartment is a first acoustical cavity formed by a first housing wall, a gasket, and a front wall of the transducer.

6. The assembly of claim 5 wherein the second compartment is a second acoustical cavity having inside walls formed by side and rear walls of the transducer and outside walls formed by side and rear walls of the enclosure.

7. The assembly of claim 6 wherein the second acoustical cavity and second exit have a resonance frequency below a resonance frequency of the transducer.

8. The assembly of claim 7 wherein the first housing way has a thickness of about 2.5 mm and the first exit is a front port having a diameter of about 3.0 mm alongside the front hole of the transducer, and wherein the first acoustical cavity has a volume of about 0.08 cc.

9. The assembly of claim 8 wherein the second acoustical cavity has a volume of about 1.6 cc.

10. The assembly of claim 9 wherein the second acoustical cavity includes two rear ports each having a diameter of about 2.0 mm.

11. The assembly of claim 7 wherein the first exit is a front port having a diameter of about 0.9 mm and the second acoustical cavity includes two rear ports, each of the rear ports having a diameter of about 2.8 mm.

12. A portable phone alerter having a sound output enhanced magnetic transducer assembly comprising:

a moving-armature magnetic transducer mounted within an enclosure in the portable phone and adapted to emit a first sound from a first portion and simultaneously to emit a second sound from a second portion, the first sound and second sound both having a phase, the phase of the second sound differing from the phase of the first sound, the transducer having one or more front holes emitting a first sound and one or more rear holes emitting a second sound;

the enclosure containing the transducer formed by a housing wall and containing a first acoustical cavity and a second acoustical cavity separated by the transducer, the first cavity having a first opening oriented generally perpendicular to the rear holes of the transducer, the second cavity being adapted to direct the second sound from the rear holes to the second opening, the second cavity together with the second opening being further adapted to shift the phase of the second sound to produce a second phase-shifted sound from the second opening, the second phase-shifted sound being in phase with the first sound so as to constructively interfere with the first sound to reinforce the first sound and produce a combined sound having a peak sound output greater than a peak sound output of the first sound or a peak sound output of the second sound, said combined sound for providing an audible alert.

13. The assembly of claim 12 wherein the second acoustical cavity and second opening each are tuned to a frequency below a diaphragm resonance frequency of the transducer.

14. The assembly of claim 13 wherein the first acoustical cavity has a volume of about 0.08 cc and the second acoustical cavity has a volume of about 1.6 cc.

15. The assembly of claim 14 wherein the housing wall has a thickness of about 2.5 mm and the first opening has a diameter of about 3.0 mm.

16. The assembly of claim 15 wherein the second opening has two ports having a diameter of about 2.0 mm.

17. The assembly of claim 14 wherein the housing wall has a thickness of 2.5 mm and the first opening has a diameter of about 0.9 mm and the rear opening has a diameter of about 2.8 mm.

18. A method of reinforced sound emission from a moving-armature magnetic transducer utilized as an alerter in a portable phone, including the steps of:

mounting the moving-armature magnetic transducer in an enclosure within the portable phone;

emitting a first sound from a first side of the magnetic transducer and a second sound from a second side of the magnetic transducer, directing the first sound into and out of a first acoustical cavity; and directing the second sound into and out of a second acoustical cavity, the step of directing the second sound also including phase-shifting the second sound to be in phase with the first sound as it exits the cavity so as to reinforce the first sound and produce a combined sound having a peak sound output greater than a peak sound output of the first sound or a peak sound output of the second sound, said combined sound for providing an audible alert.

* * * * *